US011730261B1

(12) United States Patent
Lin

(10) Patent No.: US 11,730,261 B1
(45) Date of Patent: Aug. 22, 2023

(54) BEAM STRUCTURE FOR LEG STAND OF ELECTRIC TABLE

(71) Applicant: TIMOTION TECHNOLOGY CO., LTD., New Taipei (TW)

(72) Inventor: Yu-Chang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/857,793

(22) Filed: Jul. 5, 2022

(30) Foreign Application Priority Data

Jun. 6, 2022 (TW) ..... 111120893

(51) Int. Cl.
*A47B 13/02* (2006.01)
*A47B 13/08* (2006.01)

(52) U.S. Cl.
CPC ..... *A47B 13/02* (2013.01); *A47B 13/08* (2013.01)

(58) Field of Classification Search
CPC ..... A47B 13/08; A47B 13/06; A47B 13/02; A47B 17/03; A47B 21/03; A47B 2200/0012; A47B 2200/0014; A47B 2200/0015
See application file for complete search history.

(56) References Cited

U.S. PATENT DOCUMENTS 11,490,726 B1 * 11/2022 Zhang ..... A47B 9/00
2018/0110325 A1 * 4/2018 Oberndörfer ..... A47B 13/003
2020/0154876 A1 * 5/2020 Liu ..... A47B 9/00
2021/0100355 A1 * 4/2021 Jørgensen ..... A47B 3/0809
2022/0378194 A1 * 12/2022 Lin ..... A47B 21/06

FOREIGN PATENT DOCUMENTS

| | | | | |
|---|---|---|---|---|
| CN | 214630725 U | 11/2021 | | |
| TW | M486995 U | 10/2014 | | |
| TW | M504506 U | 7/2015 | | |
| TW | M560241 U | 5/2018 | | |
| TW | M618980 U | 11/2021 | | |
| TW | M631281 U | 8/2022 | | |
| WO | WO-2018093323 A1 * | 5/2018 | ..... | A47B 1/08 |

OTHER PUBLICATIONS

Office Action dated Nov. 17, 2022 of the corresponding Taiwan patent application No. 111120893.

* cited by examiner

*Primary Examiner* — Daniel J Rohrhoff
(74) *Attorney, Agent, or Firm* — Chun-Ming Shih; HDLS IPR Services

(57) ABSTRACT

The disclosure is a beam structure for a leg stand of an electric table, which includes a first frame and a second frame. The first frame includes an inner bottom plate, an inner side plate and an inner embedding plate. The inner embedding plate is formed on outside of the inner side plate. The inner embedding plate includes an exposed section. The second frame is movably connected with the first frame. The second frame includes an outer bottom plate, an outer side plate and an outer connecting plate. The inner bottom plate is formed above the outer bottom plate. The inner side plate is formed on inside of the outer side plate. The inner embedding plate is correspondingly embedded in the outer connecting plate. The exposed section is exposed from the outer connecting plate.

8 Claims, 6 Drawing Sheets

BEAM STRUCTURE FOR LEG STAND OF ELECTRIC TABLE

BACKGROUND

Technical Field

The disclosure relates to a leg stand of an electric table, particularly to a beam structure for a leg stand of an electric table.

Description of Related Art

To correspond to different body types, body heights and users' habits, the fixed type of tables has been replaced by users. Electric lift tables with height adjustment have been the mainstream and the trend of modern designs. After adjusting the height, the tables can match users with different body heights and body types for comfort.

The prior-art leg stands of an electric table, such as the granted utility model patents from the inventor, which are TWM486995, TWM504506 and TWM560241, each of them includes a beam structure, a pair of telescopic posts and a pair of side wings. The beam structure is composed by connecting two rectangular tubes at an interval, and a receiving recess is formed between the two rectangular tubes.

However, in order to make the leg stand possess considerable strength, connecting the rectangular tubes to constitute the beam structure not only requires complicated processes but also makes the finished leg stand have a heavy weight which is disadvantageous to be shifted and transported. Also, such a heavy weight makes the material costs unable to be effectively reduced and affects the economic profit.

In view of this, the inventors have devoted themselves to the above-mentioned prior art, researched intensively and cooperated with the application of science to try to solve the above-mentioned problems. Finally, the invention which is reasonable and effective to overcome the above drawbacks is provided.

SUMMARY

An object of the disclosure is to provide a beam structure for a leg stand of an electric table, which utilizes the arrangement of each frame to keep the stability and reduce the weight to further reduce the material costs.

To accomplish the above object, the disclosure provides a beam structure for a leg stand of an electric table, which includes a first frame and a second frame. The first frame includes an inner bottom plate, two inner side plates upward bent and extended from two sides of the inner bottom plate, and two inner embedding plates bent and extended from the inner side plates respectively. Each inner embedding plate is formed on outside of each inner side plate. The inner embedding plate includes an exposed section. The second frame is movably connected with the first frame. The second frame includes an outer bottom plate, two outer side plate upward bent and extended from two sides of the outer bottom plate, and two outer connecting plates outward bent and extended from the outer side plates respectively. The inner bottom plate is formed above the outer bottom plate. Each inner side plate is formed on inside of each outer side plate. The inner embedding plate is correspondingly embedded in the outer connecting plate. The exposed section is exposed from the outer connecting plate.

The disclosure further has the following functions. By the coplanar property of the platform of each inner embedding plate and the outer connecting plate, and the rigidity of the table board, the weight of the beam structure may be effectively reduced. Each inner embedding plate is movably connected with each slot, so the disclosure may be widely applied to table boards with different lengths and specifications. By the coplanar property of the lower platform of the inner bottom plate and the outer bottom plate, the time and labor costs of on-site assembly may be saved when each telescopic post is connected to the beam structure.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
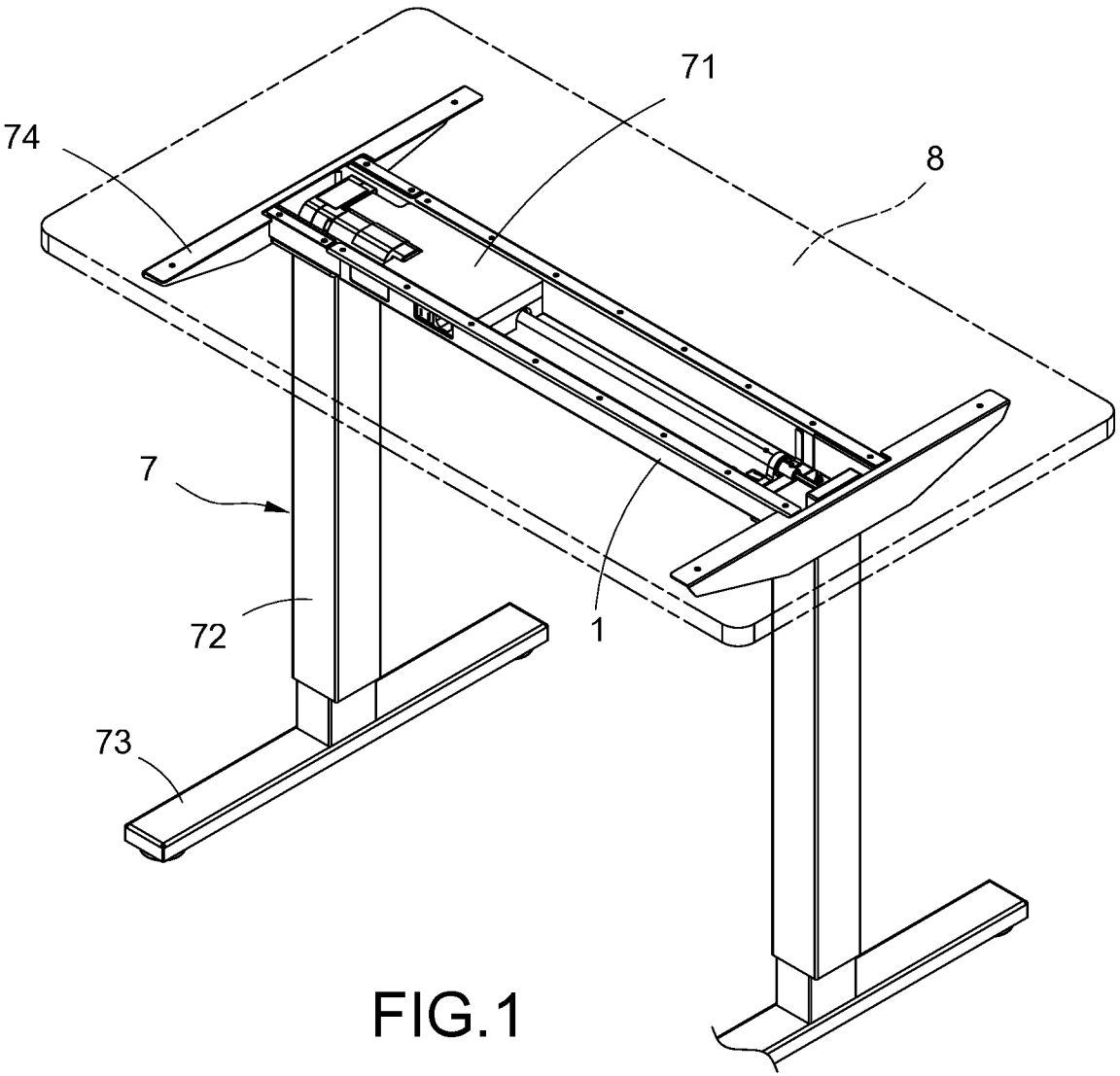
FIG. 1 is a schematic view of the beam structure of the disclosure applied to a leg stand of an electric table and connected to a table board.
Figure 2:
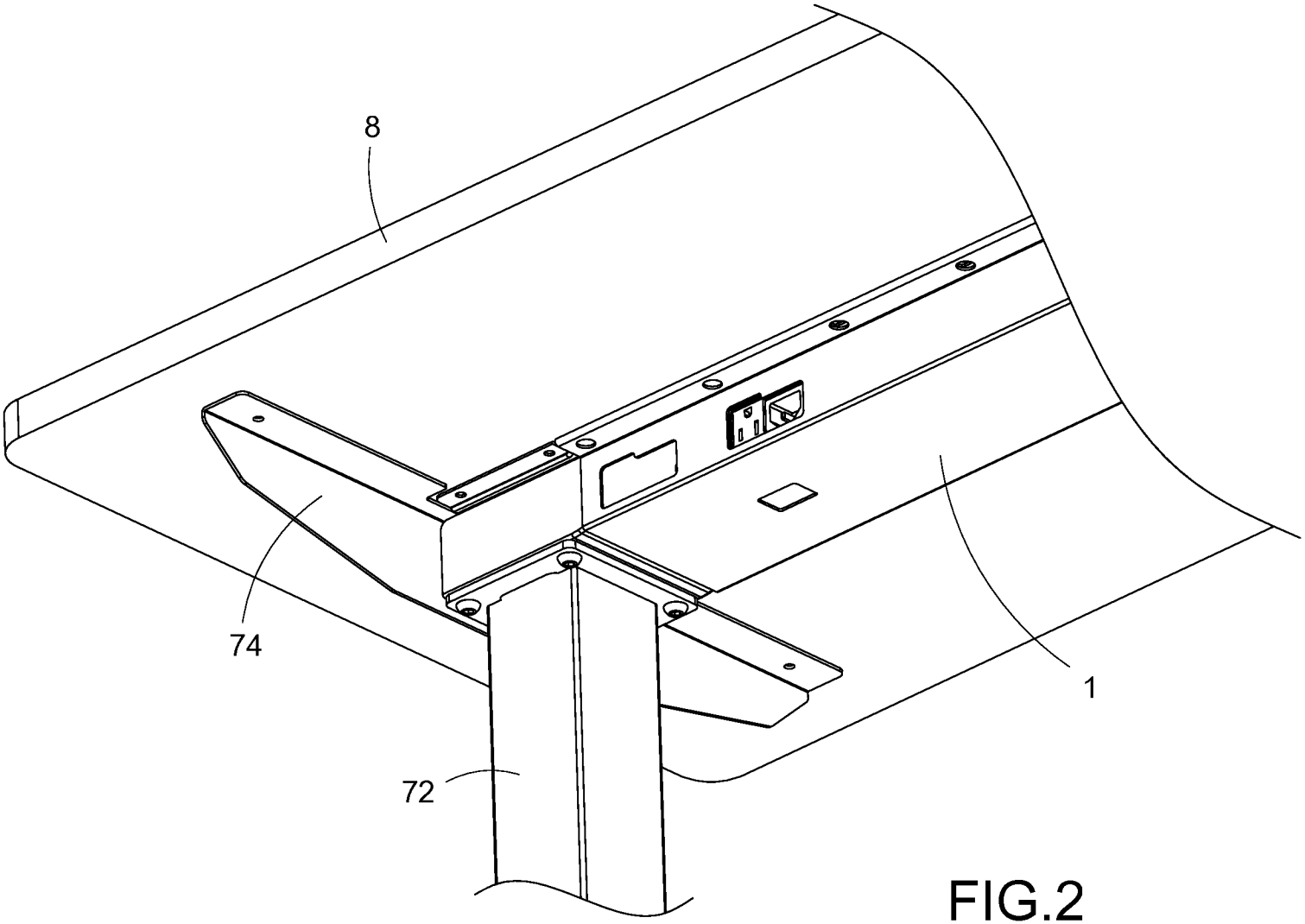
FIG. 2 is an assembled view of the beam structure of the disclosure applied to a leg stand of an electric table and connected to a table board.
Figure 3:
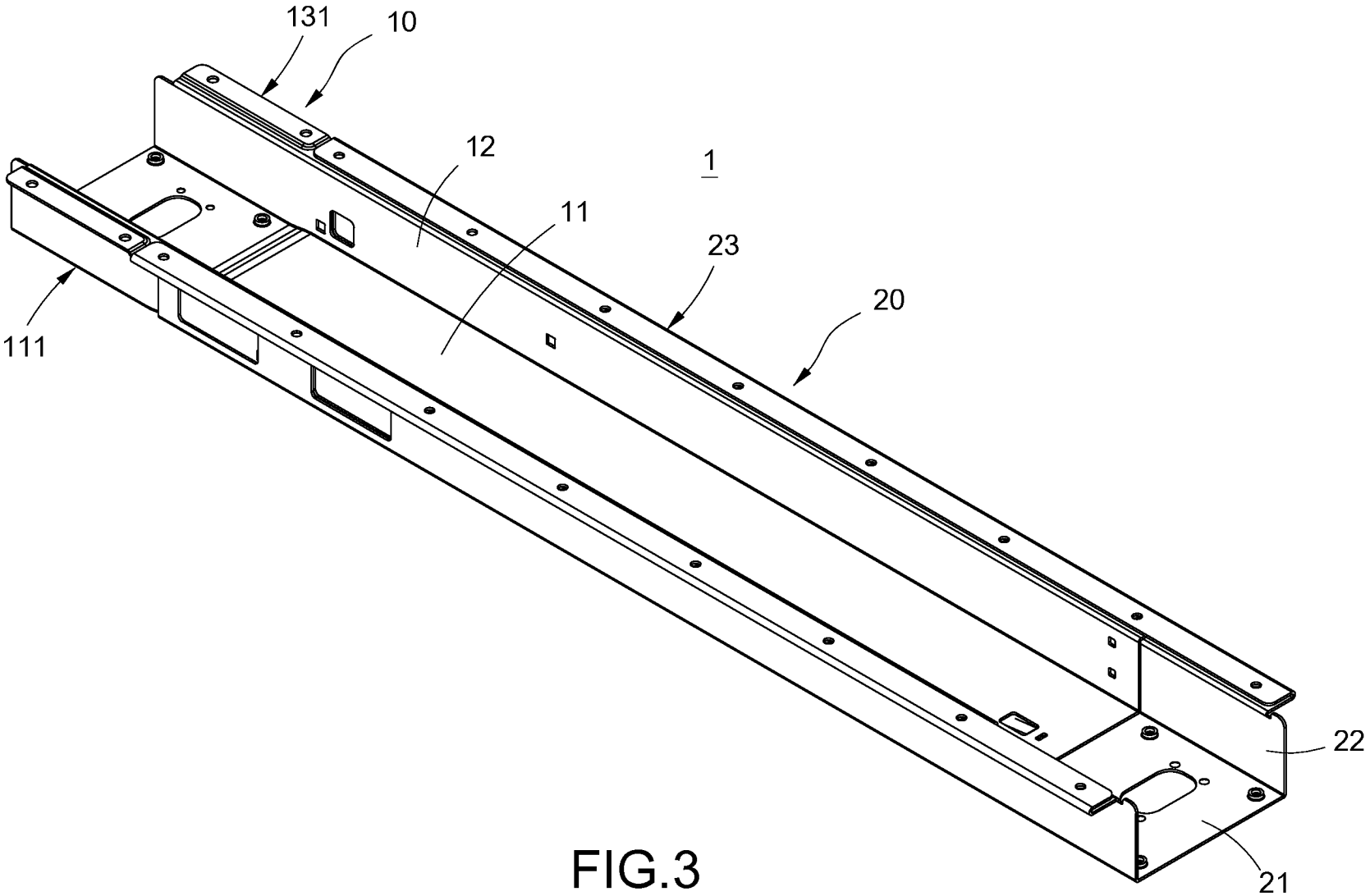
FIG. 3 is an assembled schematic view of the beam structure of the disclosure.
Figure 4:
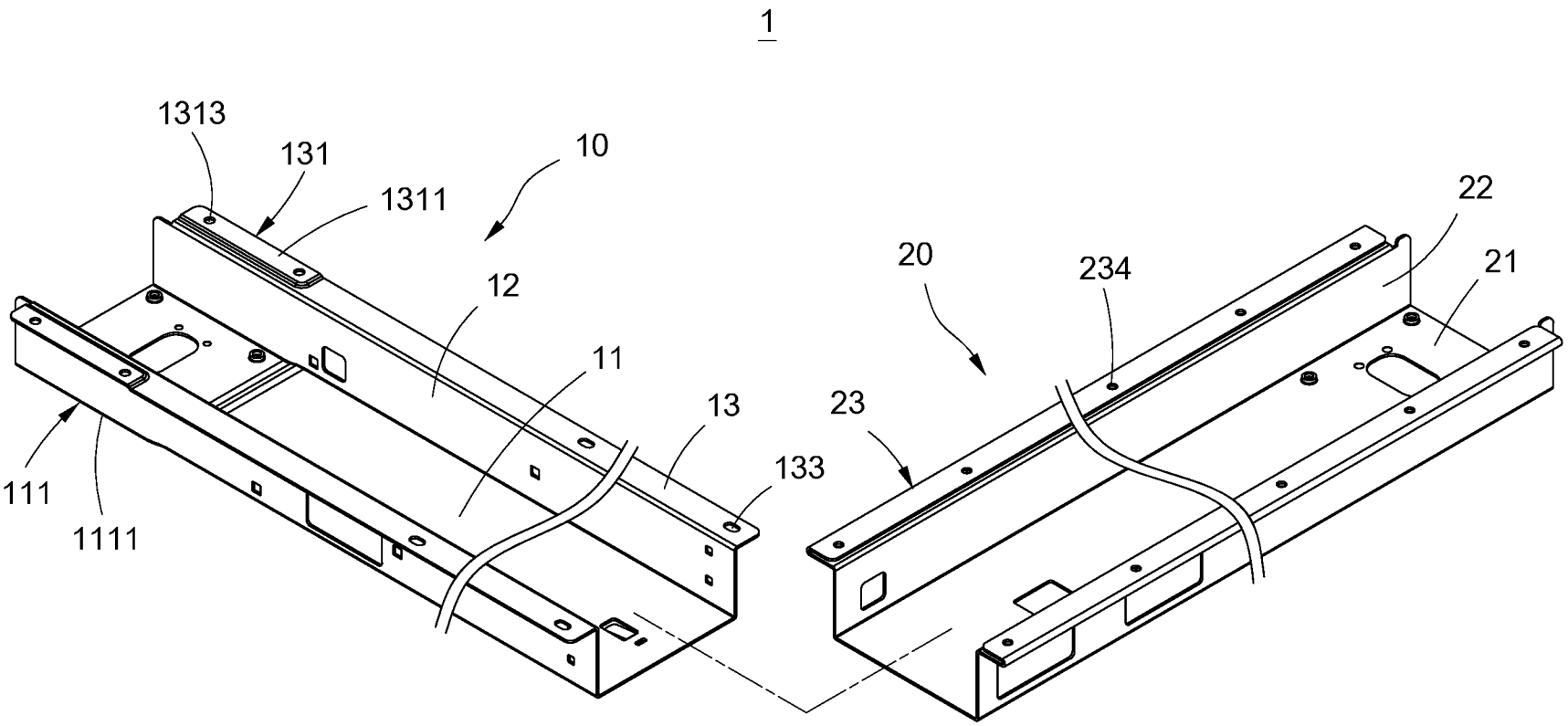
FIG. 4 is an exploded view of the beam structure of the disclosure.
Figure 5:
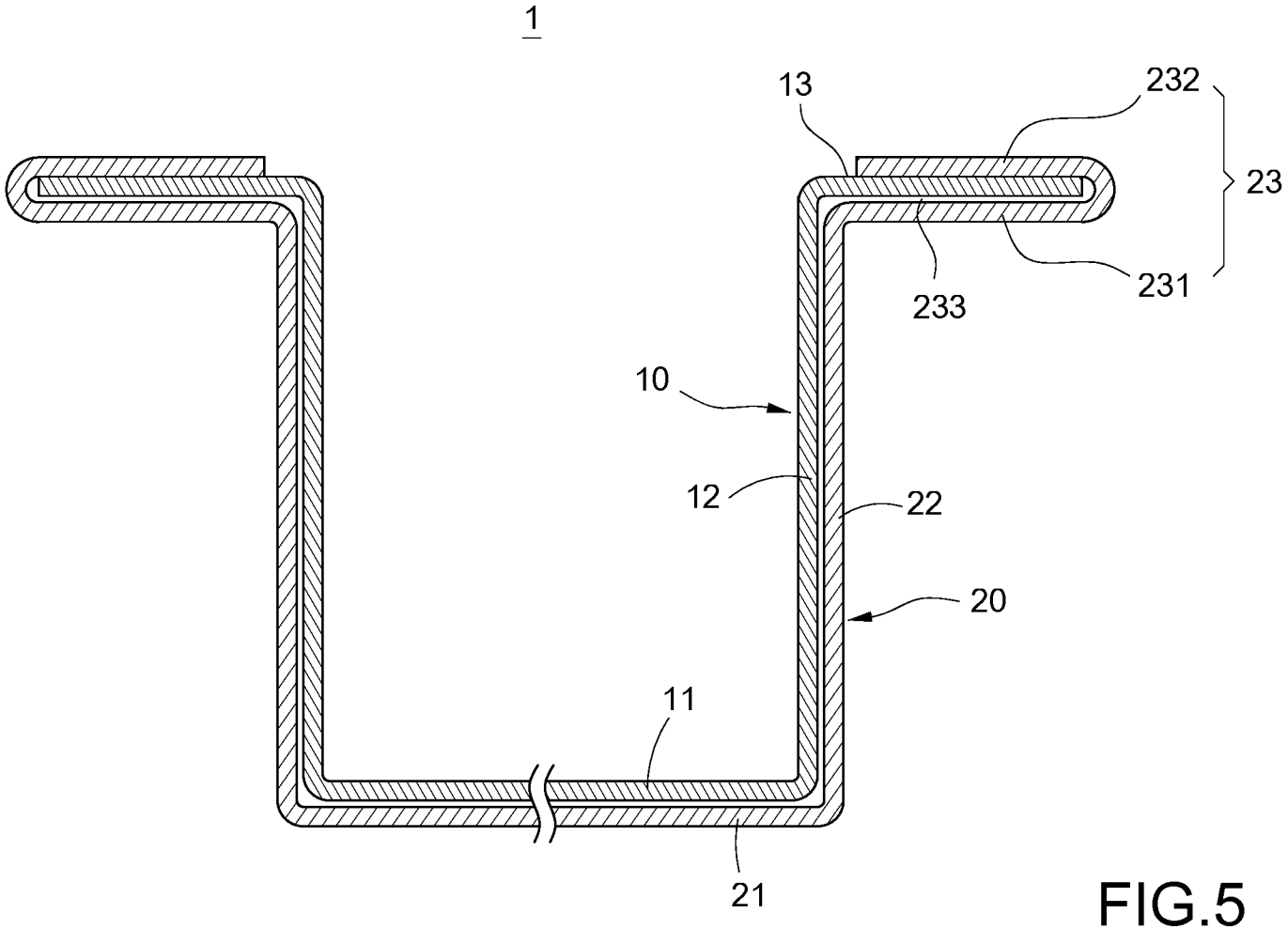
FIG. 5 is a cross-sectional view of the beam structure of the disclosure.

Please refer to FIGS. 1 and 2. The disclosure provides a beam structure for a leg stand of an electric table, which is applied to the leg stand 7 of the electric table and assembled with a table board 8 to constitute the electric table. The leg stand 7 includes a transmission 71, a pair of telescopic posts 72, a pair of support feet 73, a pair of side wings 74 and a beam structure 1. Each telescopic post 72 is separately connected to two ends of the beam structure 1. Each support foot 73 is connected to an end of each telescopic post 72, which is away from the beam structure 1. Each side wing 74 is correspondingly connected to an end of the beam structure 1. The transmission 71 is disposed in the beam structure 1 and connected with each telescopic post 72 for driving each telescopic post 72 to generate a stretching or retracting action. The table board 8 is fastened on the leg stand 7 by separately inserting screwing elements into the bean structure 1 and the side wings 74.

Please refer to FIGS. 3-6. The beam structure of the disclosure includes a first frame 10 and a second frame 20. In detail, the beam structure 1 is composed of a first frame 10 and a second frame 20.

The first frame 10 is made of a metal plate processed by punching, blanking, and bending. The first frame 10 includes an inner bottom plate 11, a pair of inner side plates 12 and a pair of inner embedding plates 13. The inner side plates 12 are upward bent and extended from a left side and a right side of the inner bottom plate 11, and are perpendicular to each other. Each inner embedding plate 13 is bent and extended from each inner side plate 12. Each inner embedding plate 13 is perpendicular to each inner side plate 12. Each inner embedding plate 13 is formed on outside of each inner side plate 12. An end of each inner embedding plate 13 has an exposed section 131.

The second frame 20 is movably connected with the first frame 10 and made of a metal plate processed by punching, blanking, and bending. The second frame 20 includes an outer bottom plate 21, a pair of outer side plates 22 and a pair of outer connecting plates 23. The outer side plates 22 are upward bent and extended from a left side and a right side of the outer bottom plate 21, and are perpendicular to each other. Each outer connecting plate 23 is bent and extended from each outer side plate 22. Each outer connecting plate 23 is perpendicular to each outer side plate 22. Each outer connecting plate 23 is formed on outside of each outer side plate 22. The inner bottom plate 11 is formed above the outer bottom plate 21. Each inner side plate 12 is formed on inside of each outer side plate 22. Each inner embedding plate 13 is correspondingly embedded in each outer connecting plate 23. Each exposed section 131 is exposed from the outer connecting plate 23.

In an embodiment, each exposed section 131 has a platform 1311 with a first upper surface 1312. Each inner embedding plate 13 has a second upper surface 132. Each first upper surface 1312 is located to be higher than each second upper surface 132. Also, each inner embedding plate 13 is disposed with multiple positioning holes 133 at intervals. The platform 1311 is disposed with two locking holes 1313. In addition, besides the single type in this embodiment, the platform 1311 may also be composed of multiple bumps at intervals.

Figure 6:
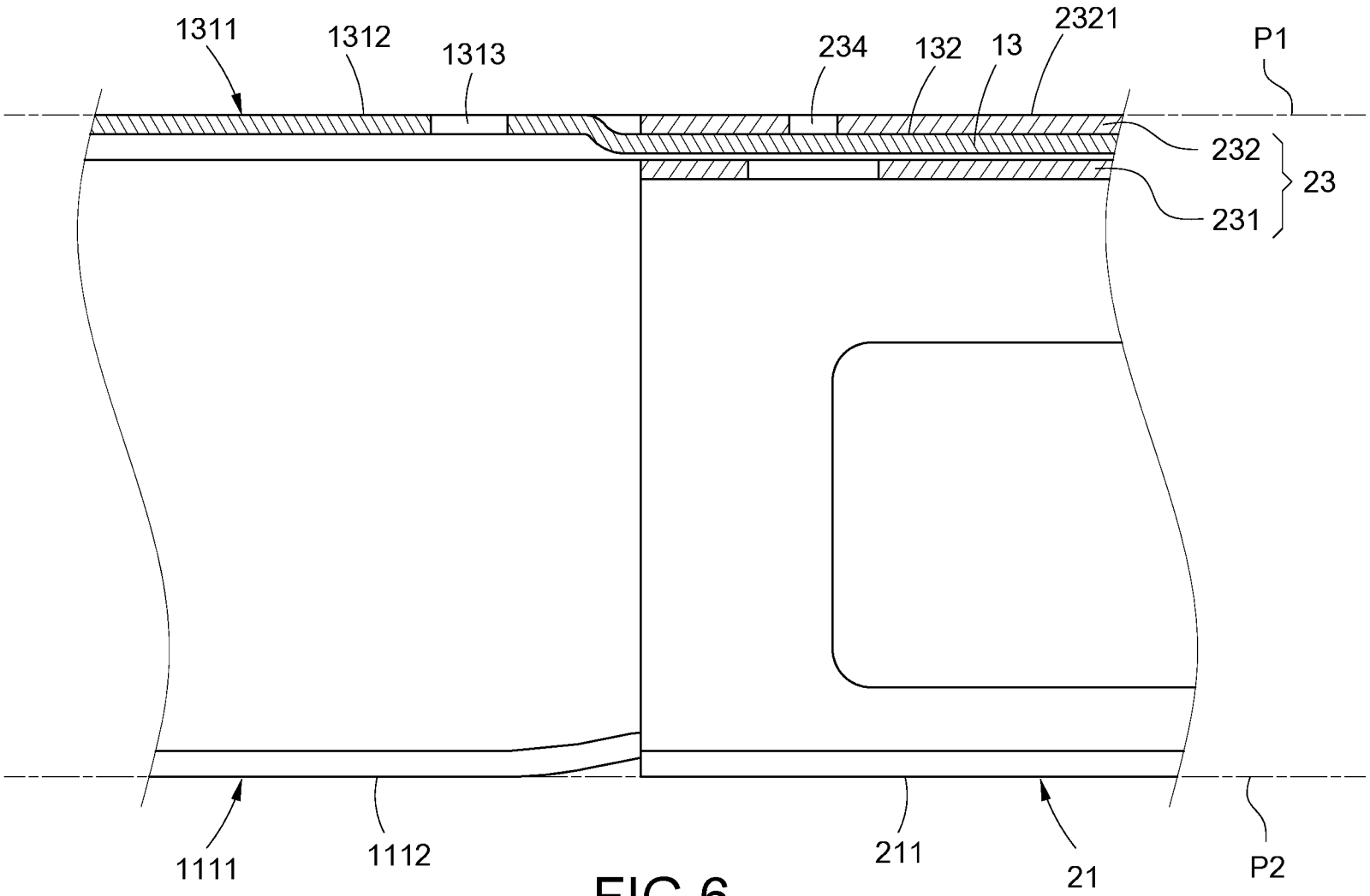
FIG. 6 is a partially assembled cross-sectional view of the inner embedding plate and the outer connecting plate of the disclosure.

In an embodiment, the inner bottom plate 11 has a lower exposed section 111. The lower exposed section 111 is exposed from the outer bottom plate 21. The lower exposed section 111 has a lower platform 1111 with a first lower surface 1112. The outer bottom plate 21 has a second lower surface 211. The second lower surface 211 and the first lower surface 1112 are substantially on the same plane P2 as shown in FIG. 6.

In an embodiment, each outer connecting plate 23 includes a lower plate 231 and an upper plate 232 extended from and formed above the lower plate 231. A slot 233 is defined between the upper plate 232 and the lower plate 231. The inner embedding plate 13 is correspondingly inserted in the slot 233. Also, the outer connecting plate 23 is disposed with multiple locking holes 234 at intervals. The positioning hole 133 may be selectively aligned with one of the locking holes 234 and fixed by inserting a screwing element (not shown in figures) into the positioning hole 133 and the locking hole 234. This embodiment uses each inner embedding plate 13 being movably and slidably connected with each slot 233 and the positioning hole 133 being selectively aligned with one the locking holes 234 to make the telescopic length of the beam structure 1 be between 1000 mm and 1600 mm.

In an embodiment, each exposed section 131 has a platform 1311 with a first upper surface 1312. The upper plate 232 of each outer connecting plate 23 has a third upper surface 2321. Each first upper surface 1312 and each third upper surface 2321 are substantially on the same plane P1 as shown in FIG. 6.

While this disclosure has been described by means of specific embodiments, numerous modifications and variations could be made thereto by those skilled in the art without departing from the scope and spirit of this disclosure set forth in the claims.

What is claimed is:

1. A beam structure for a leg stand of an electric table, the beam structure comprising:

a first frame, comprising an inner bottom plate, two inner side plates upward bent and extended from two sides of the inner bottom plate, and two inner embedding plates bent and extended from the inner side plates respectively, each inner embedding plate disposed on outside of each inner side plate, and each inner embedding plate comprising an exposed section; and a second frame, movably connected with the first frame, comprising an outer bottom plate, two outer side plates upward bent and extended from two sides of the outer bottom plate, and two outer connecting plates outward bent and extended from the outer side plates respectively, the inner bottom plate disposed above the outer bottom plate, each inner side plate disposed on inside of each outer side plate, and each inner embedding plate correspondingly embedded in each outer connecting plate, wherein the exposed section is exposed from the outer connecting plate, wherein the exposed section comprises a platform with a first upper surface, each inner embedding plate comprises a second upper surface, and the first upper surface is located to be higher than the second upper surface.

2. The beam structure of claim 1, wherein the inner bottom plate comprises a lower exposed section, and the lower exposed section is exposed from the outer bottom plate.

3. The beam structure of claim 2, wherein the lower exposed section comprises a lower platform with a first lower surface, the outer bottom plate comprises a second lower surface, and the second lower surface and the first lower surface are substantially on a same plane.

4. The beam structure of claim 1, wherein the beam structure is composed of the first frame and the second frame.

5. The beam structure of claim 1, wherein each outer connecting plate comprises a lower plate and an upper plate extended from and disposed above the lower plate, a slot is defined between the upper plate and the lower plate, and each inner embedding plate is correspondingly inserted in the slot.

6. The beam structure of claim 5, wherein the exposed section comprises a platform with a first upper surface, each upper plate comprises a third upper surface, and the first upper surface and the third upper surface are substantially on a same plane.

7. The beam structure of claim 1, wherein each outer connecting plate comprises multiple locking holes defined at intervals, each inner embedding plate comprises a positioning hole, and the positioning hole is selectively aligned with one of the locking holes to be positioned.

8. A beam structure for a leg stand of an electric table, the beam structure comprising:

a first frame, comprising an inner bottom plate, two inner side plates upward bent and extended from two sides of the inner bottom plate, and two inner embedding plates bent and extended from the inner side plates respectively, each inner embedding plate disposed on outside of each inner side plate, and each inner embedding plate comprising an exposed section; and a second frame, movably connected with the first frame, comprising an outer bottom plate, two outer side plates upward bent and extended from two sides of the outer bottom plate, and two outer connecting plates outward bent and extended from the outer side plates respectively, the inner bottom plate disposed above the outer bottom plate, each inner side plate disposed on inside of each outer side plate, and each inner embedding plate correspondingly embedded in each outer connecting plate, wherein the exposed section is exposed from the outer connecting plate, wherein the exposed section comprises a platform with a first upper surface, each outer connecting plate comprises a third upper surface, and the first upper surface and the third upper surface are substantially on a same plane.

* * * * *